United States Patent [19]

Ryan et al.

[11] Patent Number: 4,507,803

[45] Date of Patent: Apr. 2, 1985

[54] RIDING MITTENS

[76] Inventors: Harriet E. Ryan; Linda A. Ryan, both of 20803 Behrendt, Warren, Mich. 48091

[21] Appl. No.: 495,975

[22] Filed: May 19, 1983

[51] Int. Cl.[3] ..... A41D 13/08

[52] U.S. Cl. ..... 2/16; 2/158; 2/161 A

[58] Field of Search ..... 2/17, 20, 158, 159, 2/169, 161 R, 161 A

[56] References Cited

U.S. PATENT DOCUMENTS 2,041,201 5/1936 Neback ..... 2/20 X
2,141,739 12/1938 Burke ..... 2/158

FOREIGN PATENT DOCUMENTS 119582 4/1927 Switzerland ..... 2/158

*Primary Examiner*—Werner H. Schroeder
*Assistant Examiner*—Tracy Graveline

[57] ABSTRACT

Mittens for use by equestrians, designed to correctly position the reins in the riders hands while providing warmth without excessive thickness or weight. The mitten is composed of a cuff, a thumb pocket, a second pocket to encase the index, middle, and ring fingers, and a third pocket for the little finger. The mitten is made of knitted wool and a reinforcing material is applied over all area subject to excessive function or wear during normal use.

3 Claims, 5 Drawing Figures

RIDING MITTENS

To correctly hold the bridle reins in the Equestrian Arts, one must grip them between the ring and little finger, across the underside of the index, middle and ring fingers, and then between the index finger and thumb. Heretofore, equestrians have used gloves in order to assume this position while attaining some element of warmth. Unfortunately, gloves often are inadequate in their provision of warmth to the riders' relatively immobile hands.

Prior art which the inventors have been able to discover are: U.S. Pat. Nos. 680,672; 2,141,739; 2,342,547; 2,643,388; Des 50,445; Des 132,564 and Des 175,091. U.S. Pat. No. 2,141,739 discloses a mitten with a cot for the little finger, but the mitten must be fastened onto the hand for wear while holding the hand in a relaxed position during the absorption of lotions, rendering a very limited range of motion. U.S. Pat. No. Des. 50,445 discloses a mitten comprised of three pockets in the body, combined with an animal motif, positioned to resemble a puppet.

SUMMARY OF THE INVENTION

A riding mitten made of a material conducive to providing warmth, comprising a cuff section, a body section having a pocket for the thumb, a second pocket for the index, middle and ring fingers, and a third pocket for the little finger, and reinforcing material extending over all areas subject to wear during normal use.

DESCRIPTION OF THE PREFERRED EMBODIMENT

Figure 1:
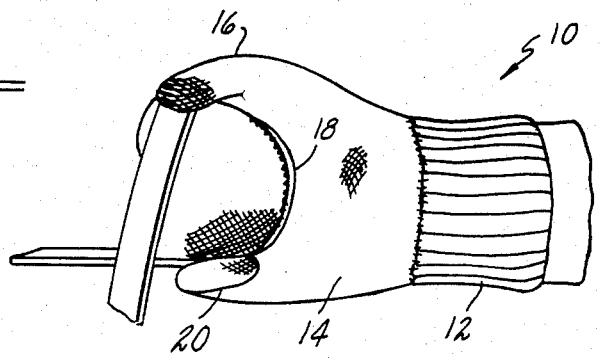
FIG. 1 illustrates the present invention on a right hand in the correct equitating position.

Referring now to the drawing, and in particular to FIG. 1 wherein there is illustrated a mitten 10 embodying the present invention, the position of the hand in FIG. 1 demonstrates the correct equitating position of taking the reins from the bit between the little and ring finger, across the palmside of the first three fingers, and then between the thumb and index finger. The mitten 10 fits loosely and comfortably over the hand of the wearer, accomodating dexterous movement of the wrist, thumb and all fingers.

Figure 2:
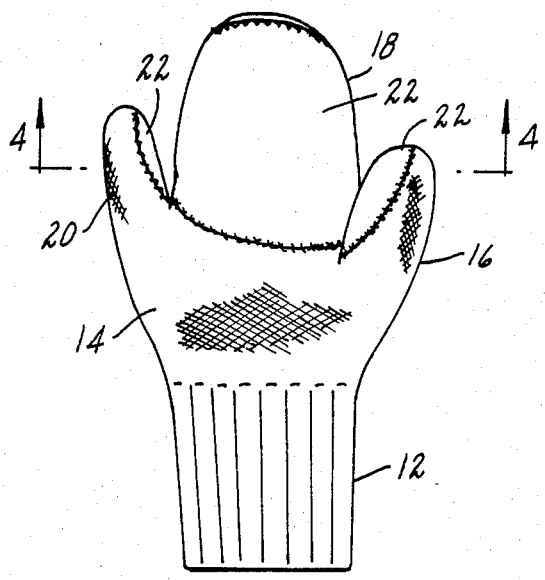
FIG. 2 illustrates a right hand, palm side.

Referring now to FIG. 2, the cuff 12 should be slightly elongated, embracing the wrist and lower portion of the arm. An elastic may be incorporated into the cuff material to ensure a snug but comfortable fit, if desired. The mitten shown in the drawing may be knit by hand or machine, preferably of wool. However, it may be produced in any known way of a preknit or synthetic material, such as a nylon and fiber-fill combination, or it may also be constructed entirely of suede or leather, requisites being that the material not be so thick or bulky as to impair the feel necessary for effectual function and structure be seamless along innersides of thumb and finger pockets. If made of leather, they may be lined to provide warmth. The body of our mitten encompasses the entire hand as a continuation of the cuff 12 and includes a hand portion 14, a thumb pocket 16, inset on the palmside, a pocket 18 for the index, middle and ring fingers, which shares a deepend crotch with an independently parallel little finger pocket 20. The thumb pocket 16, and finger pockets 18 and 20 are tapered to an oval and closed at the top, leaving only one opening at the end of the cuff section 12 for said mitten to be drawn on and off the hand.

Unless the mitten is to be made entirely of leather or suede, a durable material such as suede or leather should be applied over all areas subject to wear.

Figure 3:
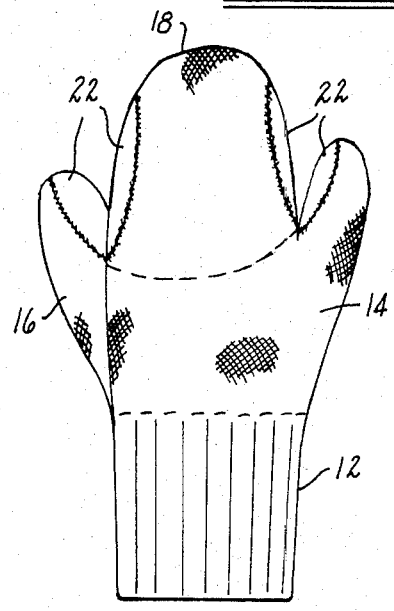
FIG. 3 illustrates a right hand, back side.
Figure 4:
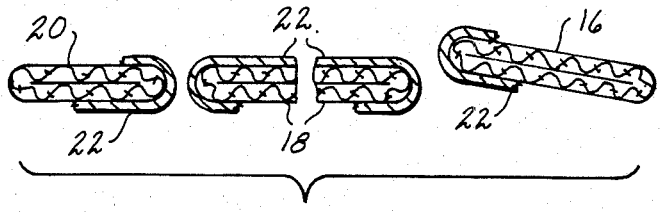
FIG. 4 illustrates a sectional view through FIG. 2 approximately on the line 4—4

Referring now to FIGS. 2, 3, & 4, the reinforcement material 22 on the three-finger pocket 18 should curl around and partially encompass the topsides of the index and ring fingers. Reinforcement material 22 should also be applied to the underside and innerside of the thumb pocket 16 and similarly to the little finger pocket 20. This reinforcement is applied where the reins or lines, as in riding, driving or leading a horse, come in contact with the hand, thus determining the points of wear, and additionally said reinforcement offers some protection to the hand from injury at points of excessive friction or stress.

Figure 5:
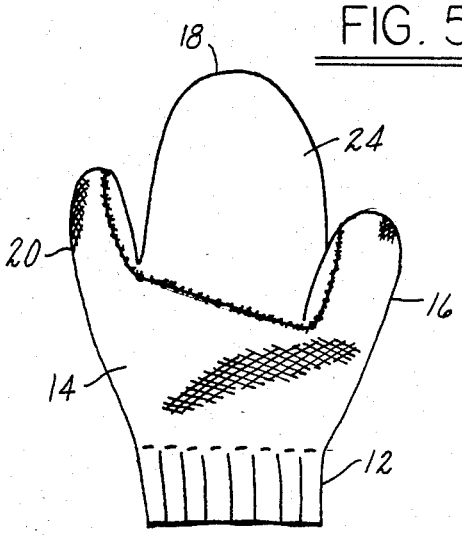
FIG. 5 illustrates a modification of the preferred embodiment.

FIG. 5 illustrates a modification of the preferred embodiment, in showing a single piece of reinforcement material 24 cut and applied to the mitten to cover all of the areas subject to wear.

While the above description contains many specifities, these should not be construed as limitations on the scope of the invention, but rather as an exemplification of preferred embodiments thereof.

Having thus described our invention, we claim:

1. A riding mitten manufactured of a material condusive to providing warmth, comprised of a cuff section and an adjoining body section having a thumb pocket, inset on the palmside, a second pocket for the index, middle and ring fingers, and a third pocket for the little finger, positioned midway up the bodyside opposite the thumb, extending independently parallel to said second pocket with which it mutually employs a seamless, deep inner crotch, all said pockets being tapered to an oval and closed at their ends leaving one opening at the end of the cuff section for said mitten to be drawn on and off the hand, and reinforcement material stitched onto the palmside of said second pocket, said reinforcement material extending from a point below the fingertips, down to a point below the base of the fingers, and curling around both sides of said second pocket to a point extending partially onto the backhand side of said second pocket.

2. A riding mitten according to claim 1 wherein additional reinforcement material is stitched onto the palmside and innerside of said thumb pocket and likewise onto palmside and innerside of said third pocket.

3. A riding mitten according to claim 2 wherein said reinforcement and said additional reinforcement is made from a single piece of material.

* * * * *